United States Patent [19]

Tetenborg et al.

[11] 4,257,210

[45] Mar. 24, 1981

[54] APPARATUS FOR LATERALLY TURNING OVER THE FLATTENED FILLING END OF FILLED LARGE SACKS FOR PREPARING THE SACK CLOSURE

[75] Inventors: Konrad Tetenborg; Helmut Hüwelmann, both of Lengerich of Westphalia, Fed. Rep. of Germany

[73] Assignee: Windmöller & Hölscher, Lengerch of Westphalia, Fed. Rep. of Germany

[21] Appl. No.: 37,348

[22] Filed: May 9, 1979

[30] Foreign Application Priority Data

May 16, 1978 [DE] Fed. Rep. of Germany ..... 2821274

[51] Int. Cl.[3] ..... B65B 7/06; B65B 7/08

[52] U.S. Cl. ..... 53/371

[58] Field of Search ..... 53/371, 378, 138 A, 53/375, 379, 387

[56] References Cited

U.S. PATENT DOCUMENTS

| | | | |
|---|---|---|---|
| 2,168,241 | 8/1939 | Robinson | 53/371 |
| 2,731,779 | 1/1956 | Milliquet | 53/371 X |
| 2,911,778 | 11/1959 | Ozor | 53/371 |
| 2,925,695 | 2/1960 | Fry | 53/371 X |

FOREIGN PATENT DOCUMENTS

| | | |
|---|---|---|
| 1948226 | 3/1977 | Fed. Rep. of Germany . |
| 2116090 | 6/1977 | Fed. Rep. of Germany . |

*Primary Examiner*—Horace M. Culver

*Attorney, Agent, or Firm*—Fleit & Jacobson

[57] ABSTRACT

Preparatory to closing a filled upright sack by a zig-zag closure, grippers engage the flattened mouth end of the sack. A support is swung to a position adjacent the flattened end and swing arms cause the end to be folded onto the support. After rollers have been swung onto backing rollers to clamp the folded-over end, the grippers are opened and withdrawn by the swing arms.

11 Claims, 5 Drawing Figures

27
26
23
22
20
31
25
24
28
20.1
1.1
29
39
3
19
9.1
9.2
9
47.1
45
46
50
49
4.1
8
47
9.3
4
7
4.2
41
9
4
40
4.2
9.2
48
4
43
1.2
1.3
3.1
1.2
X
44
5
1

APPARATUS FOR LATERALLY TURNING OVER THE FLATTENED FILLING END OF FILLED LARGE SACKS FOR PREPARING THE SACK CLOSURE

The invention relates to an apparatus for transferring and laterally turning over the filing end of filled large sacks standing on supports for the purpose of preparing for closure of the filling end by zig-zag folding, the filling end being pulled apart by spreader bars and thereby flattened.

DE-OS 26 47 432 discloses large sacks made from a tube section of fabric of plastics threads or plastics tapes coated on the outside or laminated on the outside with plastics film. On account of their size and the strength of their material, the sacks are adapted to hold a weight of 1 t and higher and their clsoure can be prepared by the above-mentioned appartus.

DE-OS 26 52 010 and the application for a patent of addition thereto filed on Apr. 27, 1978 described methods by which such large sacks can be fully automatically filled and closed. According to these methods, the sacks to be filled are first engaged laterally at their open filling end and are opened by pulling the sack walls apart before the pourable material is filled into the initially freely suspended sack, the sack thereby being slowly deposited on a support whilst maintaining tension in the side walls, the upper end of the filling aperture is closed by stretching the side walls and the flattened filling aperture is turned over sideways through an angle to permit its closure and gathering by a zig-zag fold to form a frill. In the sequence of these method steps, the present invention relates to an apparatus for turning over the flattened filling end through an angle. The aforementioned apparatus thus forms one station between an 'apparatus for suspending large sacks from the filling funnel of a sack filling apparatus' and 'an apparatus for folding the flattened filling aperture of large sacks onto itself and for closing same by closure strips', which are described in patent applications filed at the same time as the present application.

A further application filed at the same time as the present application describes a 'filling funnel for filling large sacks with pourable material', which is provided with spreader bars which project into the filling aperture of the filled large sack and pull same apart.

It is the problem of the present invention to provide an apparatus for transferring and laterally turning over the filling end which has been pulled apart by the spreader bars and thereby flattened, by means of which apparatus the sack can be prepared for its closure in a manner such that apparatuses disposed in downstream stations can take over the sack fed to it from the filling station and close it mechanically.

According to the invention, this problem is solved in that a plate which can be swung in is provided with a front supporting edge which is parallel to the edge of the flattened filling end and which can be lowered onto the contents of the sack in the region of its vertical medial plane parallel to the edge, that, in the swung in condition, the plate is at an acute angle to the horizontal support, and that on both sides of the plate there are grippers which engage the flattened filling end adjacent the spreader bars, are pivotable about an axis parallel to the supporting edge and place the filling end on the swung-in plate in a taunt condition. By depositing the flattened filling end on the oblique plate, its position is so fixed that it can be fed with the sack to downstream closure stations by being conveyed further in the direction of the supporting edge.

The flattened filling end can be securely held in abutment with the plate in that levers pivotable with the latter carry at their free ends pressure elements for pressing the flattened filling end against the plate. Desirably, the pressure elements consist of rollers of which the rotary axes are in the swung-in condition parallel to the plane of the plate and at right-angles to the supporting edge and which co-operate with backing rollers mounted in recesses in the plate. By means of the rollers, the flattened and turned-over filling end is held in contact with the plate without any marked frictional resistance opposing the further conveying of the sack with such a fixed filling aperture in the direction of the supporting edge.

Desirably, the grippers are secured to shafts which are rotatable at the free ends of the levers and on which sprockets are keyed that are operatively connected by chains to sprockets concentric with the pivotal axis of the levers so that, on pivoting of the levers, the grippers execute opposite pivotal motion out of their vertical position engaging the filling end up to their position parallel to the plane of the plate. The grippers hold the flattened filling end taut during turning over because the plane defined by the closed gripper jaws intersects the medial plane of the sack in the region of the filling level. The grippers can take over the filling end pulled apart by the spreader bars by laterally engaging over same. As soon as the grippers have taken over the as yet vertically disposed filling end, the spreader bars described in the application 'Filling funnel for filling large sacks with pourable material' filed at the same time as the present application can be pulled out vertically upwardly.

Other advantageous embodiments of the invention have been described in more detail in the subsidiary claims.

An example of the invention will now be described in more detail with reference to the drawing, wherein.

Figure 1:
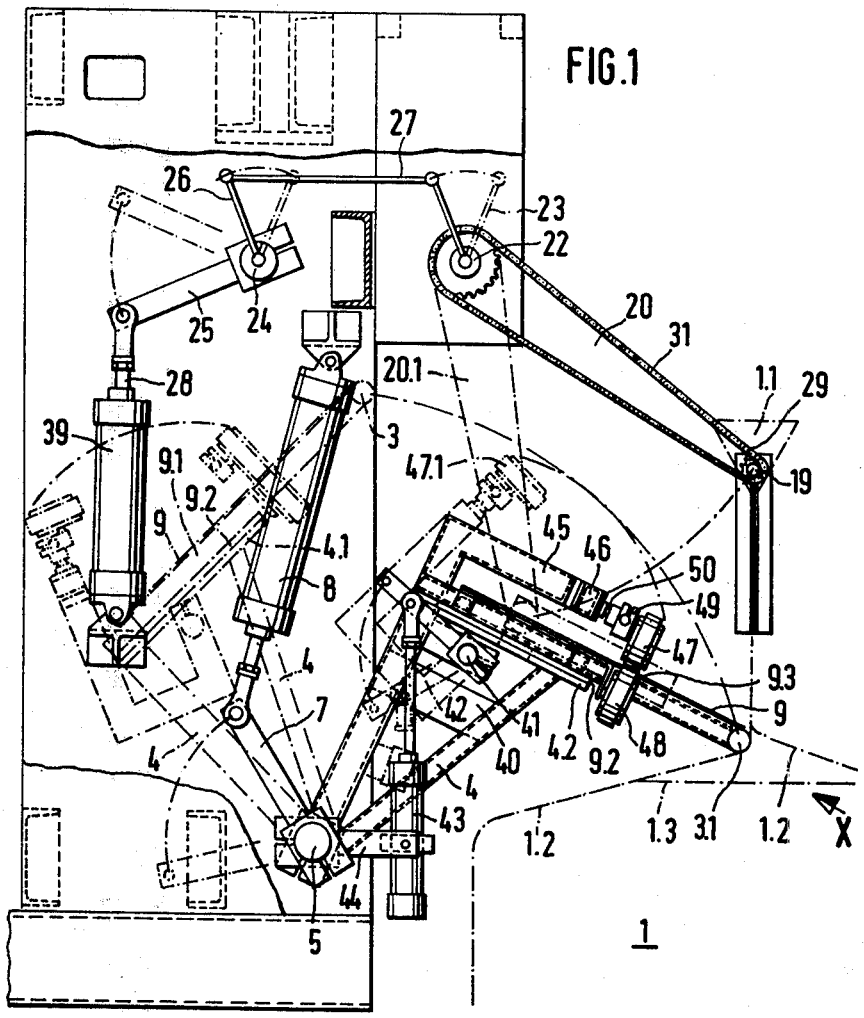
FIG. 1 is an elevation of the apparatus in the direction in which the sack is conveyed through the adjoining closure devices.
Figure 2:
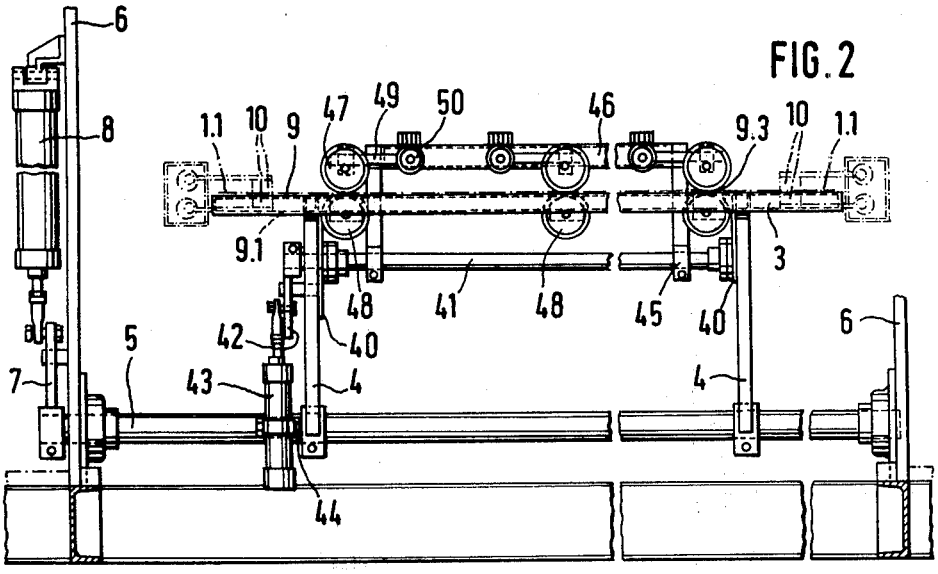
FIG. 2 is an elevation of the apparatus in the direction of the arrow X in FIG. 1.
Figure 3:
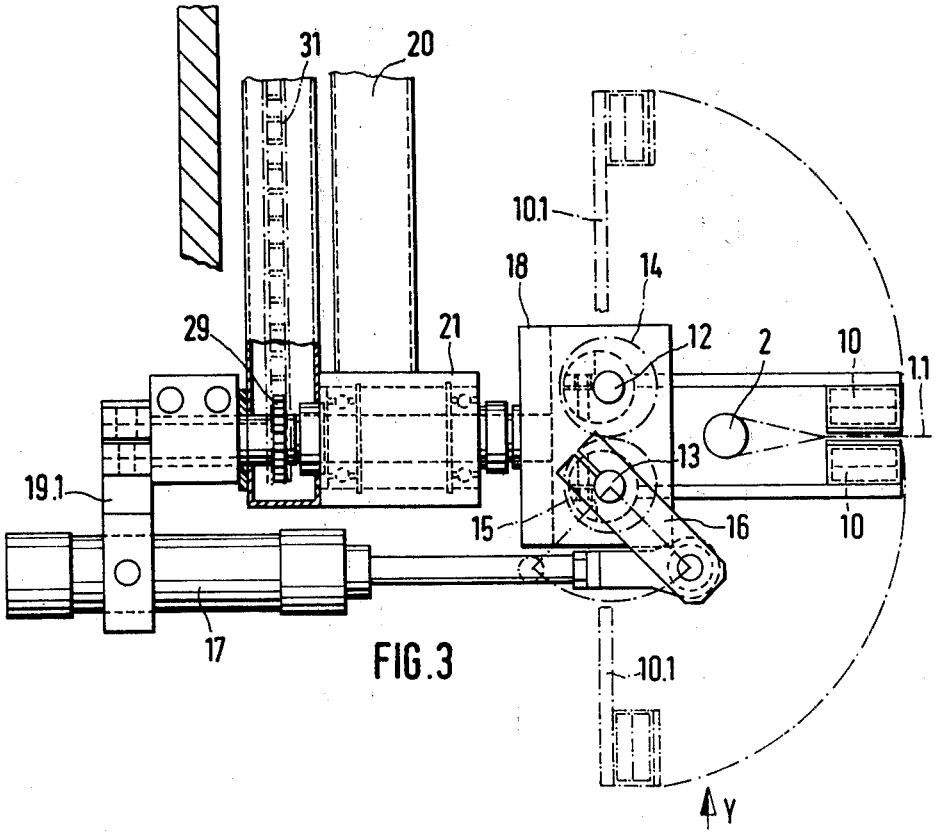
FIG. 3 is a plan view of the large sack with the filling end extending vertically and of the left-hand gripper engaging the filling end.
Figure 4:
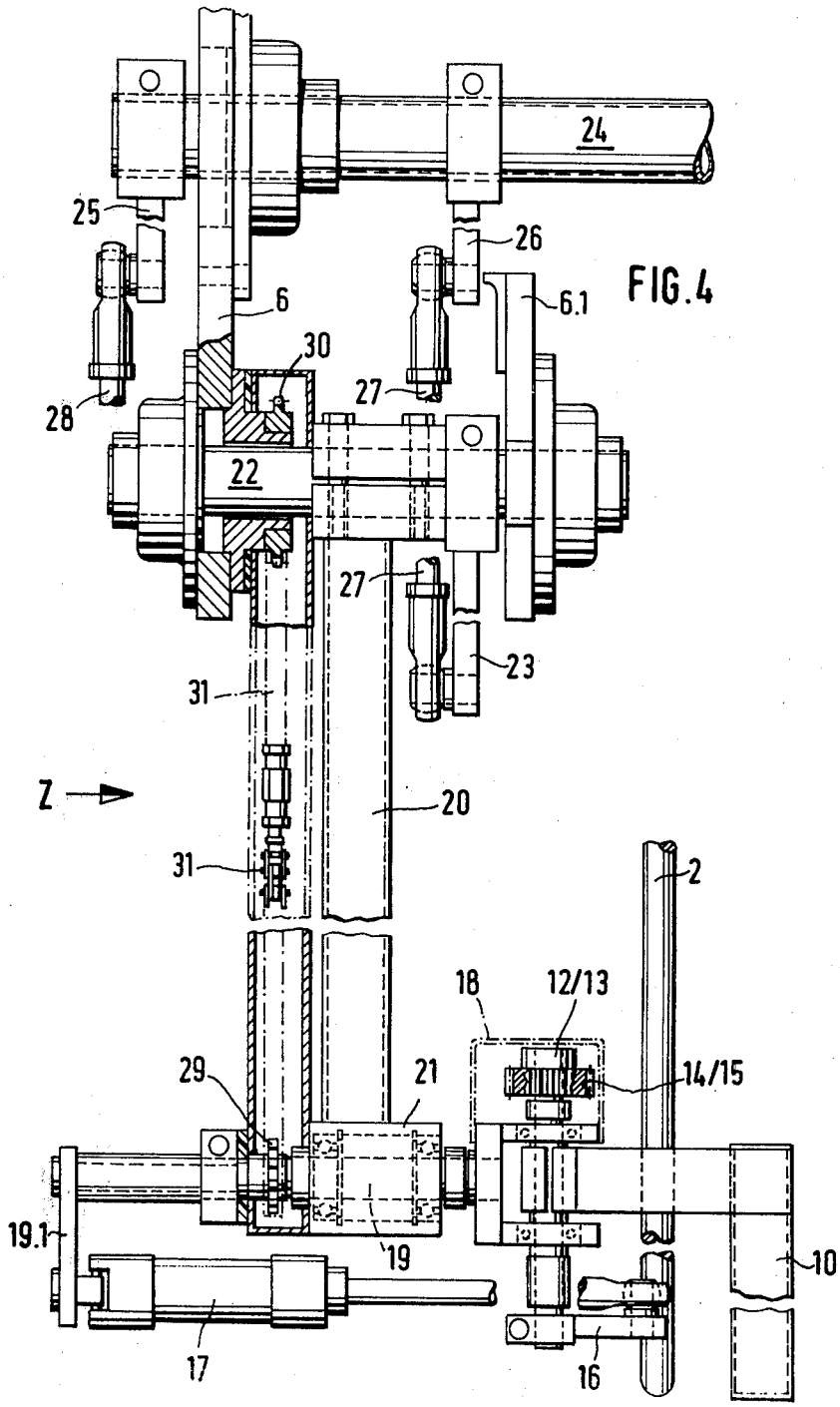
FIG. 4 is an elevation of the apparatus in the direction of the arrow Y in FIG. 3.
Figure 5:
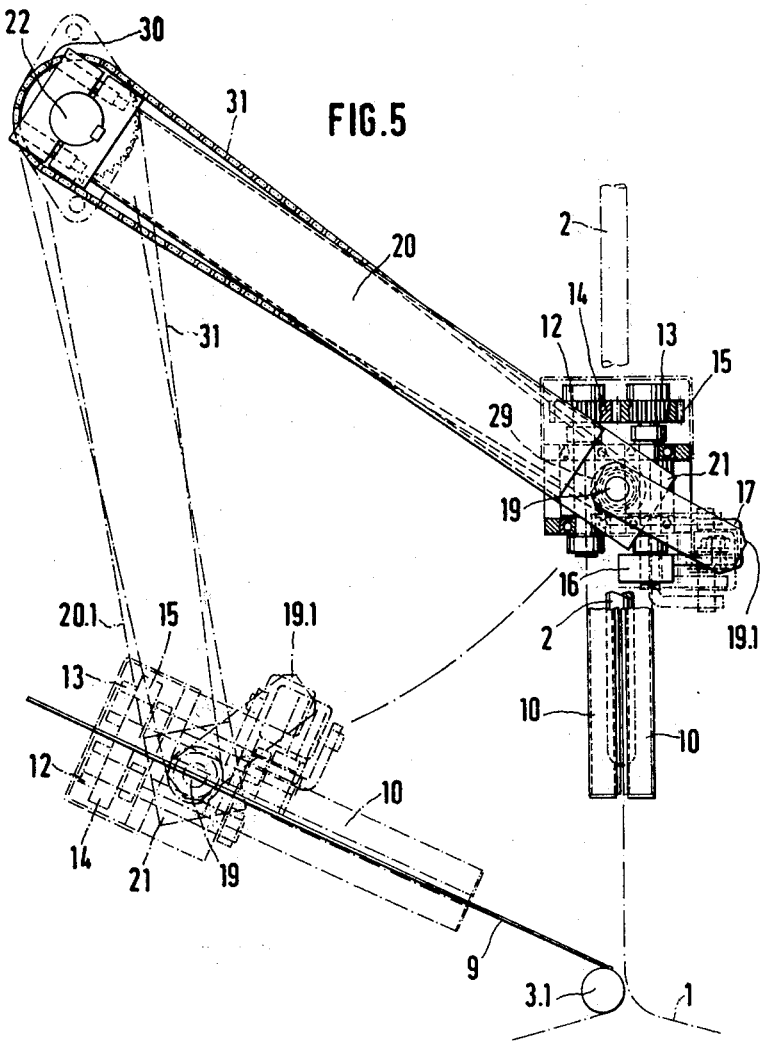
FIG. 5 is an elevation of the apparatus in the direction of the arrow Z in FIG. 4

In the filling station, the large sack 1 is upright on a support (not shown) on which it is conveyed through the subsequent closure stations. Its filling end 1.1 has been pulled apart after the filling step by gripper bars 2 which are described in more detail in the application 'Filling funnel for filling large sacks with pourable material' filed at the same time as the present application, so that its upper wall portions lie on each other above the filling level.

A bar 3 forming a supporting edge is fixed to the plate which is in the form of a table plate 9 and which is reinforced by square tubes 9.1. The square tubes 9.1 are welded to a plate 9.2 screw-connected to a plate 4.1 which can be adjusted relatively to the plate 9.2 by elongate holes 4.2.

Levers 4 fixed to a shaft 5 are welded to the plate 4.1. The shaft 5 is loosely rotatably mounted in a frame 6. A lever 7 keyed to the shaft 5 is hinged to the piston rod of a piston-cylinder unit 8 of which the cylinder is pivoted to the frame 6. By actuating the piston-cylinder unit 8, the bar 3 can be swung to a position 3.1 in which the walls of the sack designated 1.2 are placed on the filling level 1.3 of the contents of the large sack 1.

The filling end 1.1 can lie on the table plate 9, which is narrower than the flattened filling end 1.1, when the bar 3 assumes the position 3.1. Turning over onto the table plate 9 is effected by grippers 10. They engage the filling end 1.1 over the gripper bars 2 beyond same. The two halves of the grippers 10 are fixed to shafts 12, 13 on which interengaging spur gears 14, 15 are secured. The free end of a lever 16 connected to the shaft 13 is hinged to the piston rod of a piston-cylinder unit 17.

The shafts 12, 13 are mounted in a housing 18 which is fixed to a shaft 19. A plate 19.1 welded to the end of the shaft 19 remote from the housing 18 is pivotally connected to the cylinder of the piston-cylinder unit 17. By actuating the piston-cylinder unit 17, each gripper can be swung through 90° into a position 10.1.

The shaft 19 is rotatably mounted in a bearing housing 21 secured to the free end of a swing arm 20. The swing arms 20 are connected to shafts 22 which are rotatably mounted in the frame 6 and a rib 6.1 of the frame and on which levers 23 are secured. A shaft 24 parallel to the shafts 22 is rotatably mounted in the frame 6 and has a lever 25 and two levers 26 secured to it. The levers 26 are hinged to the two layers 23 by connecting rods 27. A piston-cylinder unit 39 has its piston rod 28 pivoted to the lever 25 and is able to pivot and swing arms 20 out of the position 20 to the chain-dotted position 20.1.

Sprockets 29, 30 secured to the shafts 19 and 22 are engaged by chains 31. By means of this chain drive, when the swing arms 20 are moved the grippers 10 also execute a pivotal motion, namely out of the position 10 in which the vertically disposed filling end 1.1 is engaged to a position 10.2 in which the filling end 1.1 is deposited on the table plate 9.

Before this, the rollers 47 and 48 must be swung onto the fixed turned-over container.

After reaching this position, the piston cylinder unit 17 is actuated so that the grippers 10 swing to the opened position 10.1 in which the swing arms 21 can be returned to the position 20 where the grippers 10 await the next large sack which they engage by executing the closing motion.

Upon engagement of the large sack 1 by the grippers 10, the gripper bars 2 are pulled upwardly out of the filling end 1.1.

The levers 4 carrying the table plate 9 are welded to plates 40 in which a shaft 41 is rotatably mounted. The free end of a lever 42 connected to the shaft 41 is hinged to a piston-cylinder unit 43 of which the cylinder is hinged to a lever 44 fixed to the shaft 5. Levers 45 engaging over the table plate 9 in U formation are connected to the shaft and their ends are welded together by a square tube 46. In the full line position shown in FIG. 1, rollers 47 provided at the square tube 46 cooperate with rollers 48 secured to the table plate 9. For this purpose the table plate 9 is provided with recesses 9.3.

By actuating the piston-cylinder unit 43, the rollers 47 can be swung away from the table plate to a position 47.1.

The rollers 47 are loosely rotatably mounted on levers 49 which can turn about a shaft 50 secured in the square tube 46. Under their own weight or by means of springs (not shown), they act on the wall portions of the sack held between them and the rollers 48.

The sequence of movements is as follows: the grippers 10 engage the vertically extending filling end 1.1 of the large sack. The bar 3 is swung together with the table plate 9 to the position 3.1. Thereafter, the spreader bars 2 are pulled out upwardly. The swing arms 20 swing to the position 20.1 and thereby deposit the filling end 1.1 on the table plate 9. The rollers 47 then swing onto the backing rollers 48 so that the filling end 1.1 is fixed between these rollers. Subsequently, the grippers 10 open and are swung back to the starting position by the swing arms 20. After the large sack 1 has been moved away vertically to the plane of the drawing of FIG. 1, the bar 3 is moved back to its starting position and the rollers 47 are lifted off the rollers 48. After the next large sack has been filled, the cycle is repeated in the same way.

We claim:

1. Apparatus for transferring and for laterally turning over a filling end of filled large sacks standing on horizontal supports for the purpose of preparing for closure the filling end by zig-zag folding, said apparatus comprising spreader bars for pulling apart and thereby flattening the filling end, a plate movable in an arc and having a front supporting edge extending parallel to an edge of the flattened filling end, means for moving the plate and front supporting edge into a swung-in position in which said front supporting edge is moved onto the contents of the sack in the region of a vertical medial plane parallel to the supporting edge, the plate when lowered being at an acute angle to the plane of a horizontal support for filled sacks, gripper means positioned on both sides of the plate for engaging the flattened filling end adjacent the spreader bars, said gripper means being pivotable about an axis parallel to the supporting edge for placing the filling end on the swung-in plate.

2. Apparatus according to claim 1, further comprising first lever means pivotable with the plate, and pressure means carried by said first lever means for pressing the flattened filling end against the plate.

3. Apparatus according to claim 2, wherein said gripper means further comprises backing rollers mounted in recesses in the plate, and wherein the pressure means comprises roller means of which the rotary axes are in the swung-in condition of the plate parallel to the plane of the plate and at right-angles to the supporting edge and which cooperate with said backing rollers mounted in recesses in the plate.

4. Apparatus according to claim 3, further comprising a frame, second lever means secured to said plate for controlling movement thereof, shaft means for supporting said second lever means for pivotable movement about an axis fixed with respect to the frame, and said first lever means carrying the roller means comprising levers pivotably mounted on said shaft means with U-shaped lever arms engaging over the plate.

5. Apparatus according to claim 4, wherein said first lever means comprises a bar connecting the free ends of the U-shaped lever arms, said roller means being secured to said bar.

6. Apparatus according to claim 5, comprising spring means for biassing said first lever means on at least one side of the roller means.

7. Apparatus according to claim 1, characterized in that the supporting edge comprises a round rod.

8. Apparatus according to claim 1, further comprising a frame, and levers having first ends pivotably mounted in the frame for movement about an axis parallel to the supporting edge, said gripper means being secured to said levers.

9. Apparatus according to claim 8, further comprising shaft means rotatably connected to second ends of said levers for supporting said gripper means, first sprocket means keyed to said shaft means, second sprocket means concentric with the pivotal axis of the levers, and chain means for interconnecting said first and said second sprocket means so that, on pivoting of the levers, the gripper means execute opposite pivotal motion between vertical positions engaging the filling end and positions parallel to the plane of the plate.

10. Apparatus according to claim 9, comprising lever means for controlling closing and opening of the gripper means, and piston-cylinder unit means for controlling movement of said lever means, said piston-cylinder unit means being hinged at one end to said shafts and hinged at a second end to said lever means.

11. Apparatus according to claim 1, characterized in that the plate and support include an angle of 25°.

* * * * *